United States Patent [19]

Grossi

[11] 4,012,044

[45] Mar. 15, 1977

[54] HANGMAN GAME APPARATUS

[76] Inventor: James Grossi, 101 Twin Rivers Drive, Toms River, N.J. 08753

[22] Filed: Oct. 1, 1975

[21] Appl. No.: 618,329

[52] U.S. Cl. ..... 273/130 E; 273/135 AD; 273/135 D; 273/135 F; 46/22; 46/116

[51] Int. Cl.[2] ..... A63F 3/00; A63H 3/16

[58] Field of Search ... 273/130 E, 135 AA, 135 AD, 273/135 D, 135 F, 135 R, 136 W, 157 R (U.S. only), 119 R; 46/116, 22, 119, 120

[56] References Cited

UNITED STATES PATENTS

| | | | |
|---|---|---|---|
| 1,343,136 | 6/1920 | Javelet | 273/119 R |
| 1,354,910 | 10/1920 | Ketchum | 273/130 E |
| 1,685,723 | 9/1928 | Robins | 273/135 D |
| 2,373,367 | 4/1945 | Wilson | 46/120 |
| 3,075,304 | 1/1963 | Votolato | 273/157 R |
| 3,407,530 | 10/1968 | Grant et al. | 273/157 R |
| 3,565,437 | 2/1971 | Mitchell | 273/134 AD |
| 3,565,439 | 2/1971 | Krouse et al. | 273/135 D |
| 3,948,526 | 4/1976 | Lukacik | 273/130 E |

*Primary Examiner*—Richard C. Pinkham
*Assistant Examiner*—Harry G. Strappello
*Attorney, Agent, or Firm*—Jack D. Slobod

[57] ABSTRACT

A hangman game includes a three dimensional miniature gallows with an operable trap door over which a noose is pendently supported. Separate head, torso, arm, hand, leg and foot components include magnets positioned for the components to be engaged in the form of a human representation. The head component is proportioned to be carried by the noose. A rack for letter blocks to construct a pre-selected word is secured to the platform and a spinner is provided for determining by chance the number of letters which the preselected word is to contain.

3 Claims, 6 Drawing Figures

HANGMAN GAME APPARATUS

FIELD OF THE INVENTION

The present invention relates generally to hangman games. In its particular aspects the present invention relates to the provision of a miniature three dimensional gallows including a noose for supporting a human figure representation constructed of separate mutually engageable components.

BACKGROUND OF THE INVENTION

The word guessing game of hangman is well known in the prior art and is generally played with only pencil and paper. Further, various hangman type games have been suggested in the prior art of which U.S. Pats. Nos. 3,394,935 and 3,734,506 are illustrative. These prior art hangman type games, in my judgement, have not introduced a sufficient amount of drama in the game to make it exciting to play.

OBJECTS OF THE INVENTION

It is an object of the present invention to provide a hangman game apparatus which introduces elements of drama and realism into the game not heretofore possible.

It is a further object of the present invention to provide a three dimensional minature gallows and human figure components to attached for suspension from the gallows.

SUMMARY OF THE INVENTION

Briefly, the aforementioned and other objects of the present invention are satisfied by providing a miniature three dimensional gallows including a platform having an operable trap door. A noose is suspended over the trap door and separate magnetically interconnectable human figure components, including head, torso, arm and leg representations are provided. The head is proportioned to be carried in the noose, so that a human figure, suspended from the noose can be constructed in steps from the components.

For keeping track of the correctly guessed letters of a preselected word and of the positions of the letters, a rack is provided secured to the platform which accepts letter blocks.

Also a spinner is provided for determining by chance the length of the word selected.

Other objects, features and advantages of the present invention will become apparent upon perusal of the following detailed description of the preferred embodiment thereof when taken in conjunction with the appended drawing wherein.

DETAILED DESCRIPTION

Figure 1:
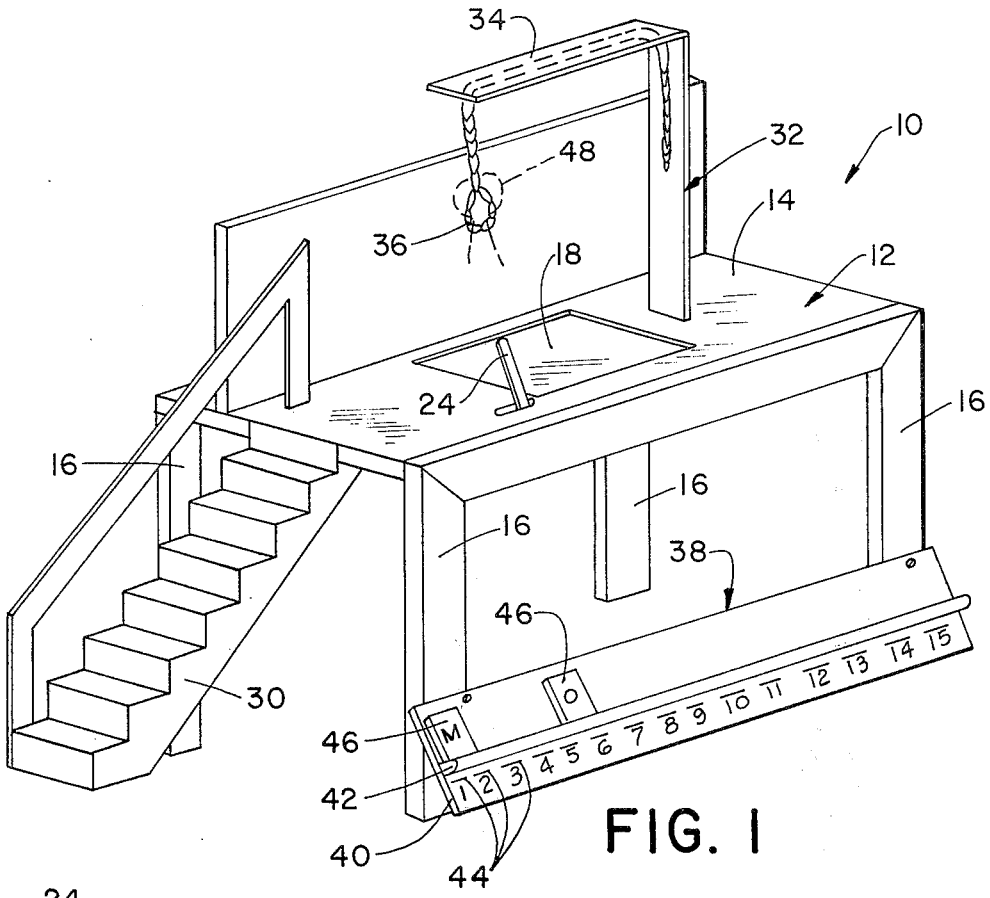
FIG. 1 is a pictorial presentation, generally in elevation of a gallows for the game of the present invention including a trap door.
Figure 2:
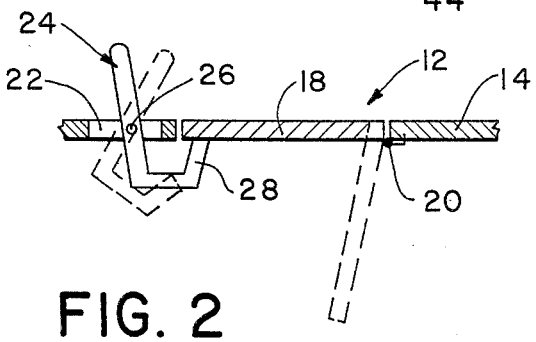
FIG. 2 is a cross sectional elevational fragmentary view through the trap door in FIG. 1.

Referring first to FIGS. 1 and 2 of the drawing, the hangman game of the present invention includes a miniature three dimensional molded plastic gallows 10. Gallows 10 includes a platform 12 having a planar top 14 supported on four legs 16. A trap door 18 is set into a rectangular cutout in top 14 and is hinged to the top at 20 for downward swinging movement.

An elongated slot aperture 22 is provided in top 14 and a lever 24 is pivotly mounted in the slot at 26. The lever 24 passes through slot 22 and includes an upturned leg 28 which adpated to rest under the free end of the door for supporting it in a horizontal position when the upper end of the lever is positioned away from door 18. The trip door 18 is released to swing downward when the upturned leg 28 is moved away from door 18 by rocking the upper portion of lever 24 toward the door.

The gallows 10 further has a series of simulated steps 30 leading up to top 14. A vertical support 32 projecting upward from top 14 has a cantilevered member 34 at its upper end from which a rope noose 36 is suspended directly over trap door 18.

Further, a horizontally elongated rack 38 is secured to two legs 16 of gallows 10. Rack 38 is generally an elevationally inclined plate 40 having ledge 42 running the length of an projecting perpendicularly to the front face of the plate. Below ledge 42 are a series of sequentially numbered indicia 44 defining letter spaces along the ledge.

Figure 5:
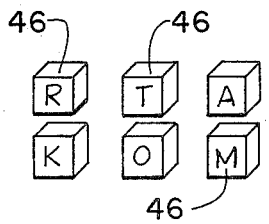
FIG. 5 is a view of a collection of blocks for the game of the present invention.

Referring also to FIG. 5, a collection of rectangular blocks 46 of wood or plastic is provided. Each block 46 has a different letter indicia thereon. Preferably there are enough blocks 46 to correspond to each letter of the alphabet. As shown in FIG. 1, the blocks 46 are proportioned to rest upon ledge 42 within the confines of the individual spaces defined by indicia 44.

Figure 3:
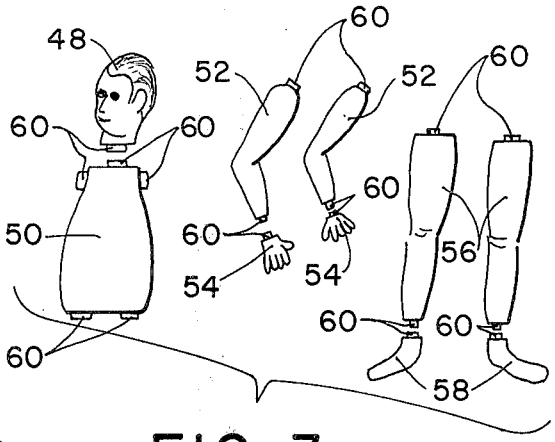
FIG. 3 is a view of a collection of human figure components for the game of the present invention.

Now referring to FIG. 3, there is illustrated a group of components for constructing a representation of a human figure to be hanged on gallows 10. There is a head component 48, a torso component 50, two arm components 52, two hand components 54, two leg components 56 and two foot components 58. The components 48–58 are preferably molded of plastic and may be connected as a human figue representation by engaging projecting magnetic buttons 60 on the components. The torso 50 has five magnetic buttons 60 for removable attachment of the head 48, arms 52 and legs 56 thereto. The arms 52 and 56 each have two magnetic buttons 60 at opposite ends and the hands 54 and feet 58 each have one magnetic button for being removably secured respectively to buttons on the arms and legs.

The head 48 is proportioned to be carried in noose 36 so that the human representation may be built in steps suspended from noose 36 utilizing components 48–58.

Figure 4:
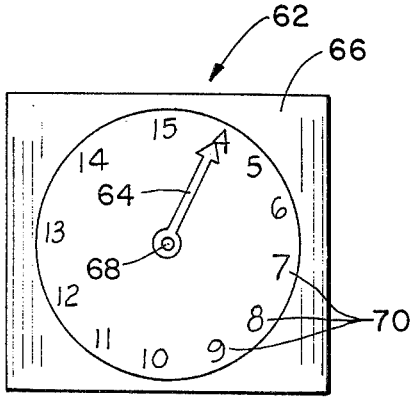
FIG. 4 is a plan view of a spinner for the game of the present invention.
Figure 6:
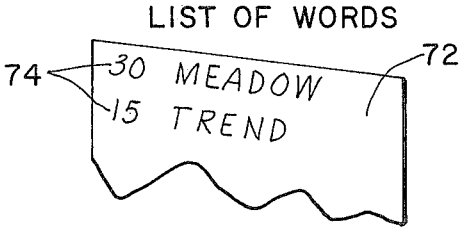
FIG. 6 is a word list for the game of the present invention.

The game of the present invention further comprises a spinner 62, illustrated in FIG. 4, composed of a spinable hand 64 pivotly mounted on a cord 66 at point 68. Numerical indicia 70 are angularly spaced about the point 68 on card for selection by chance. Additionally, a list 72 of words of varying length may be supplied, as illustrated in FIG. 6.

PLAYING THE GAME

The game is played by two players each of which has his own gallows 10 and human figure components 48–58. The spinner 62 is utilized to determine by chance the number of letters which a word is to contain, the selected indicia 70 being the length of the word. The players each select a different word to be guessed by the other player of the selected length. The word chosen by each player is preferably selected from the word list 72. Alternatively, the words chosen may be any word.

The spinner is then utilized to determine by chance which player is to go first. This is done preferably based on which player spins the hand 69 to point to a larger number indicia 70. The player who goes first tries to guess the word of the other player by guessing a letter. If the letter guessed is in the preselected word, the other player must advise the first player of the letter's position therein. The first player then utilizes the block 46 having the appropriate letter and places it in the appropriate space 44 on rack 28.

If the guessed letter is not in the word, the other player sets the head 48 in the noose 36 of his gallows in an effort to build the human representation of the other player in steps. The other player then goes in the same manner.

The players alternately try to guess letters of the word of the other player and upon each failure another component 48–58 is added toward hanging of the player guessing wrong. It will be appreciated that this action is quite dramatic. The game is ended either by a word being guessed or by the hanging of one of the players being completed. The completed hanging is signalled dramatically by actuating lever 24 to swing trap door 18 downward.

Words may be different point values, either by assigning different numerical values to each letter on blocks 46 or by point values 74 appearing alongside the words in list 72.

While the preferred embodiment of the present invention has been described in specific detail, it should be noted that numerous modifications additions and omissions in the details thereof are possible within the intended spirit and scope of the invention claimed herein.

What is claimed is:

1. A hangman game comprising: a miniature three dimensional gallows having a platform including an operable trap door and a noose pendently suspended over the trap door; component means for constructing a representation of a human figure to be suspended from said noose, said component means including separate head, torso, arm and leg components; said components carrying mutually engageable magnetic buttons for removably engaging said components to each other to construct said representation in steps starting with said head component; said head component being proportioned to be carried in said noose.

2. The game of claim 1 further comprising a plurality of blocks having letter indicia thereon, and a rack for said blocks secured to said platform for indicating correctly guessed letters of a preselected word.

3. The game of claim 2 further comprising chance means for selecting the number of letters which said preselected word is to contain.

* * * * *